US005263426A

United States Patent [19]

Morita et al.

[11] Patent Number: 5,263,426

[45] Date of Patent: Nov. 23, 1993

[54] COMBUSTION APPARATUS

[75] Inventors: Shigeki Morita, Hiroshima; Kouji Kuramashi; Shigeto Nakashita, both of Kure; Keiji Ishii, Kamagaya; Tadashi Jimbo, Kure; Kunio Hodozuka, Kure; Akira Baba, Kure; Hironobu Kobayashi, Katsuta, all of Japan

[73] Assignee: Babcock-Hitachi Kabushiki Kaisha, Tokyo, Japan

[21] Appl. No.: 835,456

[22] PCT Filed: Jun. 27, 1991

[86] PCT No.: PCT/JP91/00868

§ 371 Date: Mar. 2, 1992

§ 102(e) Date: Mar. 2, 1992

[87] PCT Pub. No.: WO92/00489

PCT Pub. Date: Jan. 9, 1992

[30] Foreign Application Priority Data

Jun. 29, 1990 [JP] Japan ..... 2-169971
Jul. 23, 1991 [JP] Japan ..... 2-192916

[51] Int. Cl.[5] ..... F23D 1/00

[52] U.S. Cl. ..... 110/265; 110/264; 110/347

[58] Field of Search ..... 110/261, 263, 264, 265, 110/347; 431/284, 285

[56] References Cited

U.S. PATENT DOCUMENTS 4,545,307 10/1985 Morita et al. ..... 110/264
4,807,541 2/1989 Masai et al. .
5,090,339 2/1992 Okiura et al. ..... 110/263

FOREIGN PATENT DOCUMENTS 88100956 7/1988 China .
0160146 3/1984 European Pat. Off. .
0280568 2/1988 European Pat. Off. .
2729476 6/1977 Fed. Rep. of Germany .
3140798 10/1981 Fed. Rep. of Germany .
1516717 12/1987 U.S.S.R. .

OTHER PUBLICATIONS

Patent Absracts of Japan-Publishing No. JP59086809-Pub. date May 19, 1984 Application date Sep. 11, 1982-Application No. JP820195274.
Chinese Office Action and translation of same.

*Primary Examiner*—Edward G. Favors
*Attorney, Agent, or Firm*—Antonelli, Terry, Stout & Kraus

[57] ABSTRACT

A combustion apparatus including a mixture feeding pipe for injecting a mixture of pulverized coal and combustion air into a furnace, with the mixture then being ignited. A radially outwardly flared flame maintaining ring is provided at a tip end of the mixture feeding pipe, with the maintaining ring being exposed to a reduced atmosphere and to high temperatures due to radiant heat from the furnace. A projection extends into the furnace beyond the flame maintaining ring so as to protect the flame maintaining ring from radiation from inside the furnace thereby suppressing an excessive increase in temperature. Combustion air flows along a surface of the projection so as to provide at oxidized atmosphere. A pulverized coal/air separating member extends within the mixture feeding pipe, and a portion or separation of the flow forcibly occurs is locally formed in a conical end portion of the pulverized coal-/air separating member, whereby it is possible to effect a complete combustion in a stabilized manner regardless of the unit capacity and load of the combustion apparatus.

4 Claims, 11 Drawing Sheets

COMBUSTION APPARATUS

FIELD OF THE INVENTION

This invention relates to a combustion apparatus, and for example, to a combustion apparatus of a pulverized coal boiler.

BACKGROUND OF THE INVENTION

In a pulverized coal firing boiler, a combustion apparatus injects a mixture of pulverized coal and air into a furnace through a mixture feeding pipe. The mixture injected is ignited so as to form a flame in the furnace. As directed in U.S. Pat. No. 4,545,307, a radially outwardly flared flame maintaining ring is provided at an end of the mixture feeding pipe. Vortices of the mixture are formed along the flame maintaining ring so that the pulverized coal is concentrated in the vicinity of the flame maintaining ring. As a result, an ignition takes place from the end portion of the mixture feeding pipe located in the furnace to form a high temperature strong reduction flame, thereby making it possible to suppress the generation of nitrogen oxides (NOx).

Disadvantages of the above construction reside in the fact that the flame maintaining ring gets, covered with ashes and is maintained under a reduced atmosphere and, further is exposed to high temperature due to radiant heat from the furnace. These conditions may cause a burnout of the flame maintaining ring or, when the operation is not proper, a formation of slag on the flame maintaining ring, that is, promotion of the slagging, under certain circumstances. The burnout of the flame maintaining ring or the formation of the slag results in the deterioration of the effect of the flame maintaining ring, an increase of the amount of NOx, or the trouble of the apparatus.

SUMMARY OF THE INVENTION

Accordingly, an object of the present invention is to provide a combustion apparatus capable of effecting a low NOx combustion in a stabilized manner regardless of the unit capacity or the operating load of the combustion apparatus.

To this end, according to the present invention, a radiation from the flame is shut off and one of three factors of occurrence of the slagging, namely, high temperature, reduced atmosphere and existence of ash, is eliminated.

According to the present invention, a projection extends into a furnace beyond a flame maintaining means so as to adequately prevent radiation from the inside of the furnace to the flame maintaining means and to suppress an excessive increase in temperature, thereby restraining the burnout of the flame maintaining means and the occurrence of the slagging on the flame maintaining means.

DETAILED DESCRIPTION

Figure 1:
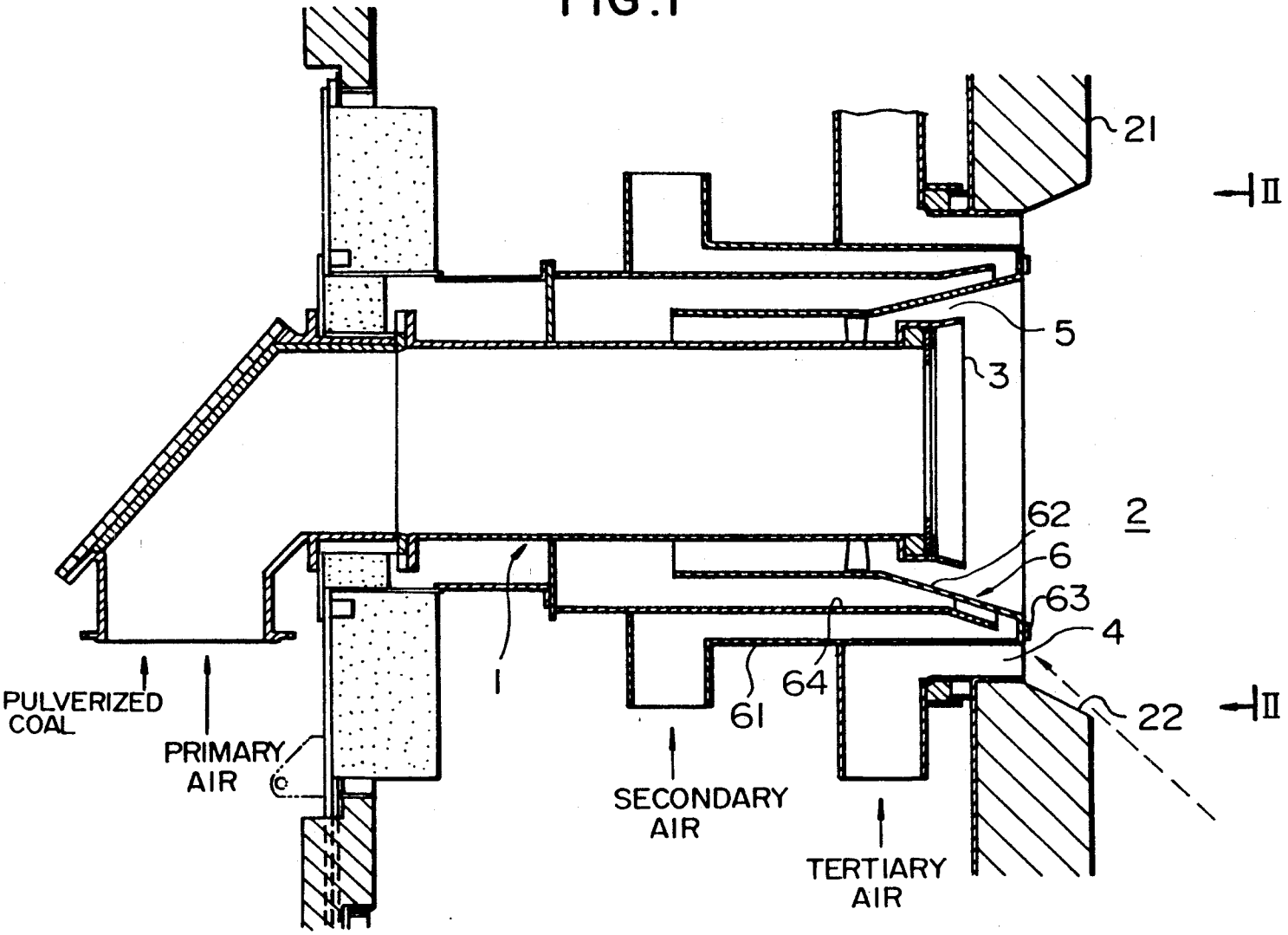
FIG. 1 is a sectional view of a combustion apparatus according to an embodiment of the present invention.

Referring to FIG. 1, a combustion apparatus has is provided which includes a bent mixture feeding pipe, with the combustion apparatus serving to burn pulverized coal as powdery fuel in air as oxygen-containing gas. The mixture feeding pipe 1 faces at one end thereof into a furnace 2 through an opening 22 formed in a furnace wall 21 of the furnace 2 and communicates at the other end thereof with a coal mill (not shown). A mixture of the pulverized coal and the primary air flows through the mixture feeding pipe 1. The mixture is ignited to form a flame in the furnace 2.

Figure 2:
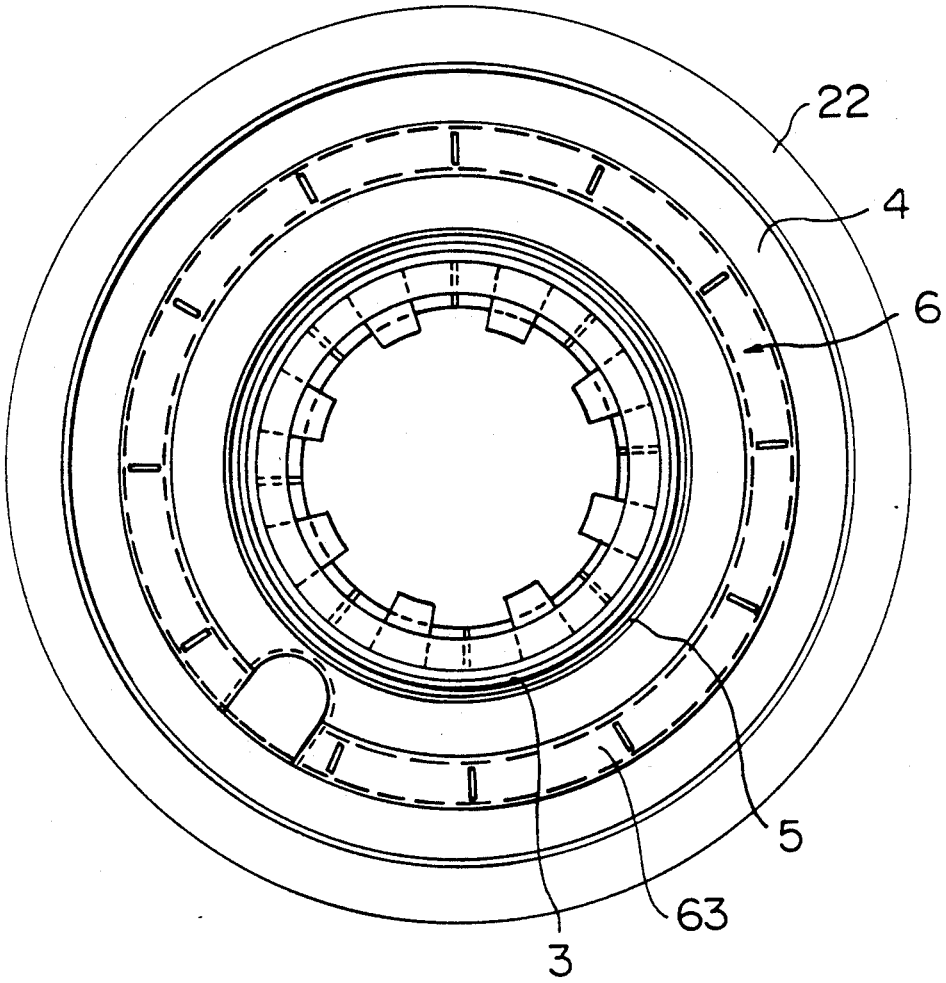
FIG. 2 is a front view taken along the lines II—II in FIG. 1.

A flame maintaining ring 3 having an L-shaped cross-section is provided at the peripheral end portion of the mixture feeding pipe 1. As shown in in FIG. 2, an annular flow passage 4 is so as disposed radially outwardly of the mixture feeding pipe 1 to be concentric therewith. Tertiary air is fed into the furnace 2 through the flow passage 4.

An annular projection 6 is disposed between the mixture feeding pipe 1 and the flow passage 4. The projection 6 extends into the furnace 2 beyond the flame maintaining ring 3. An outer peripheral wall 61 of the projection 6 extends in parallel with the mixture feeding pipe 1 and an inner peripheral wall 62 thereof expands radially outwardly at its end portion. Both peripheral walls 61 and 62 terminate in an end disk 63.

Figure 3:
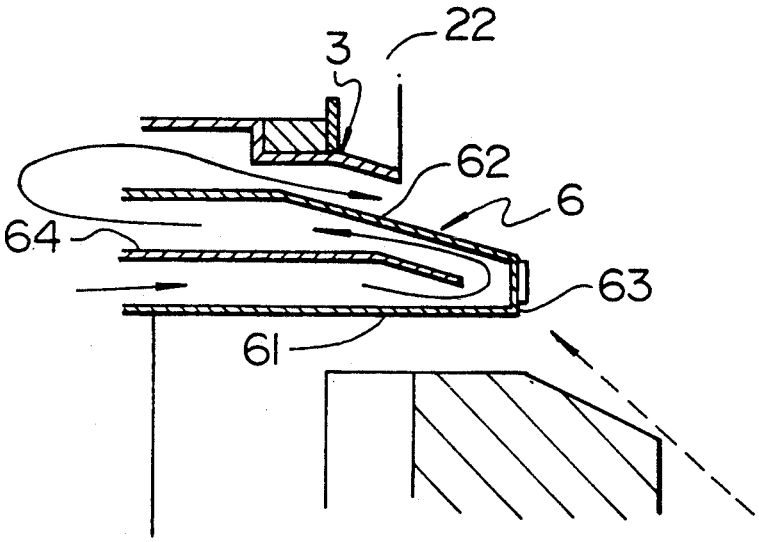
FIG. 3 is a partly fragmentary sectional view illustrating a projection shown in FIG. 1.

Referring to FIGS. 1 and 3, an interior of the projection 6 is divided into two layers by a partition tube 64. Secondary air flows in a zigzag manner through a passage portion defined by the outer peripheral wall 61 of the projection 6 and the partition tube 64, a passage portion defined by the inner peripheral wall 62 of the projection 6 and the partition tube 64 and a passage portion defined by the inner peripheral wall 62 of the projection 6 and the mixture feeding pipe 1, as indicated by arrows, and then flows into the furnace 2. Since the inner peripheral wall 62 of the projection 6 expands in radially outwardly direction at the end portion thereof, the secondary air is reduced at a speed thereof, so that a part of the secondary air can be consumed for maintaining the flame without disturbing the jet of the mixture. This makes it possible to form a high temperature reduction flame in a stabilized manner. Consequently, it is possible to suppress the production of NOx.

The flame maintaining ring 3 is at a reduced atmosphere, and the pulverized coal is concentrated in the vicinity of the flame maintaining ring due to vortices. Further, the flame maintaining ring 3 is usually exposed to high temperatures attributable to the radiant heat from the furnace as indicated by broken lines in FIGS. 1 and 3. However, since the projection 6 extends beyond the flame maintaining ring 3 into the furnace 2 to moderately prevent radiation toward the flame maintaining ring, the flame maintaining ring 3 is not exposed to an excessively high temperature. Consequently, even when the unit capacity of the combustion apparatus is increased, for example, above 50 MW thermal, the flame maintaining ring 3 is protected from being burnt out or exposed to the production of slag.

On the other hand, the projection 6 is now brought into a state where it gets covered with ashes and is disposed in the reduced atmosphere and, further, exposed to high temperatures due to the radiant heat from the furnace 2. For this reason, there is a possibility that the projection 6 may be subjected to the slagging. To cope with this, in the present invention, the projection 6 is not disposed in the reduced atmosphere but an oxidized atmosphere. By so doing, one of factors of occurrence of the slagging can be eliminated, thereby making it possible to prevent the occurrence of the slagging.

Figure 4:
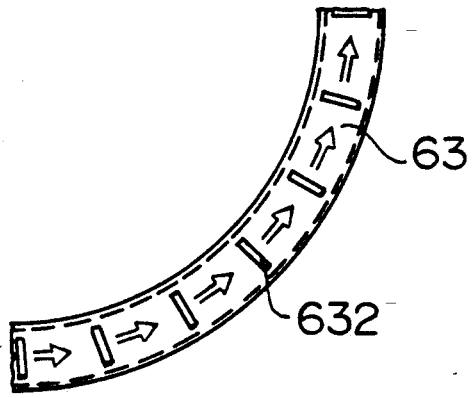
FIG. 4 is a partly fragmentary front view of the projection of FIG. 3.
Figure 5:
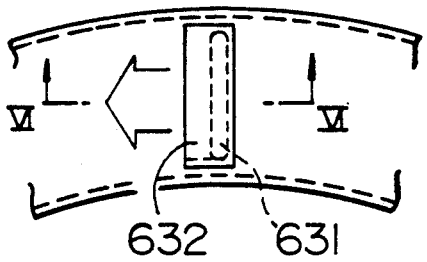
FIG. 5 is an enlarged fragmentary front view of the projection of FIG. 4.
Figure 6:
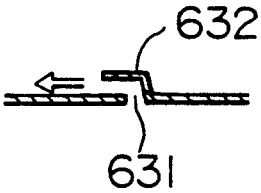
FIG. 6 is a sectional view taken along the lines VI—VI in FIG. 5.

To form the oxidized atmosphere, an end disk 63 is provided with a plurality of radial slits 631 which are equiangularly spaced, as shown in FIGS. 4 to 6. A part of the secondary air is jetted out of these slits 631 and is guided by guide plates 632 so that a secondary air flows circumferentially on the surface of the projection 6. Consequently, the projection 6 can be maintained under the oxidized atmosphere, resulting in the prevention of the production of slag.

It is noted in this embodiment that the secondary air cools the projection 6 while the secondary air flows through the passage portion defined by the outer peripheral wall 61 of the projection 6 and the partition tube 64, the passage portion defined by the inner peripheral wall 62 of the projection 6 and the partition tube 64 and the passage portion defined by the inner peripheral wall 62 of the projection 6 and the mixture feeding pipe 1. The flow of the secondary air of about 300° C. results in the temperature of the projection being about 950° C. or below, at which temperature hardly any slag is produced. Consequently, it is possible to minimize the formation of slag at the projection 6 as well as to increasing the service life of the projection 6. On the other hand, since the temperature of the secondary air is increased by about 40° C. due to the radiant heat from the furnace 2, the combustion efficiency can be improved.

Figure 7:
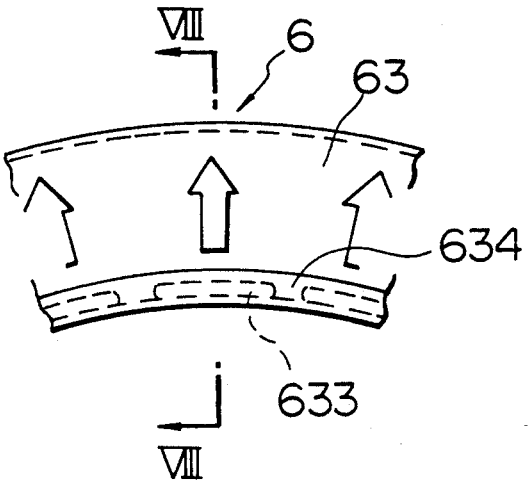
FIG. 7 is a partly fragmentary front view illustrating a modification of the projection.
Figure 8:
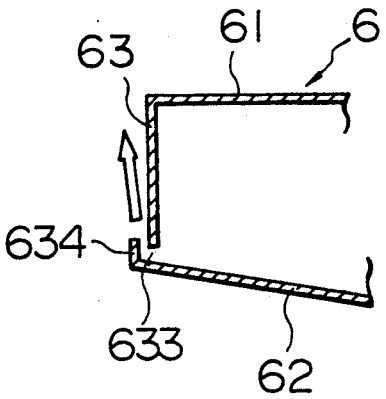
FIG. 8 is a fragmentary sectional view taken along the lines VIII—VIII in FIG. 7.
Figure 9:
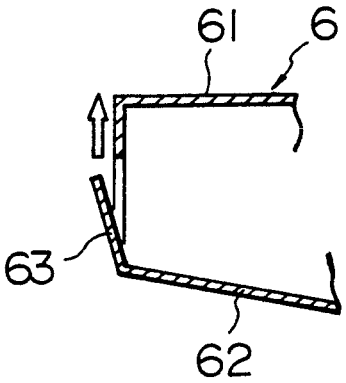
FIG. 9 is a fragmentary sectional view illustrating another modification of the projection.

In a modification shown in FIGS. 7 and 8, a plurality of circumferential slits 633 are disposed in the end disk 63, so that a part of the secondary air is guided by a guide plate 634 to flow radially outwardly on the surface of the projecting 6. As a result, a production of slag can be prevented as in the above described embodiment. In another modification shown in FIG. 9, the end disk 63 is partially cut off and inclined.

Figure 10:
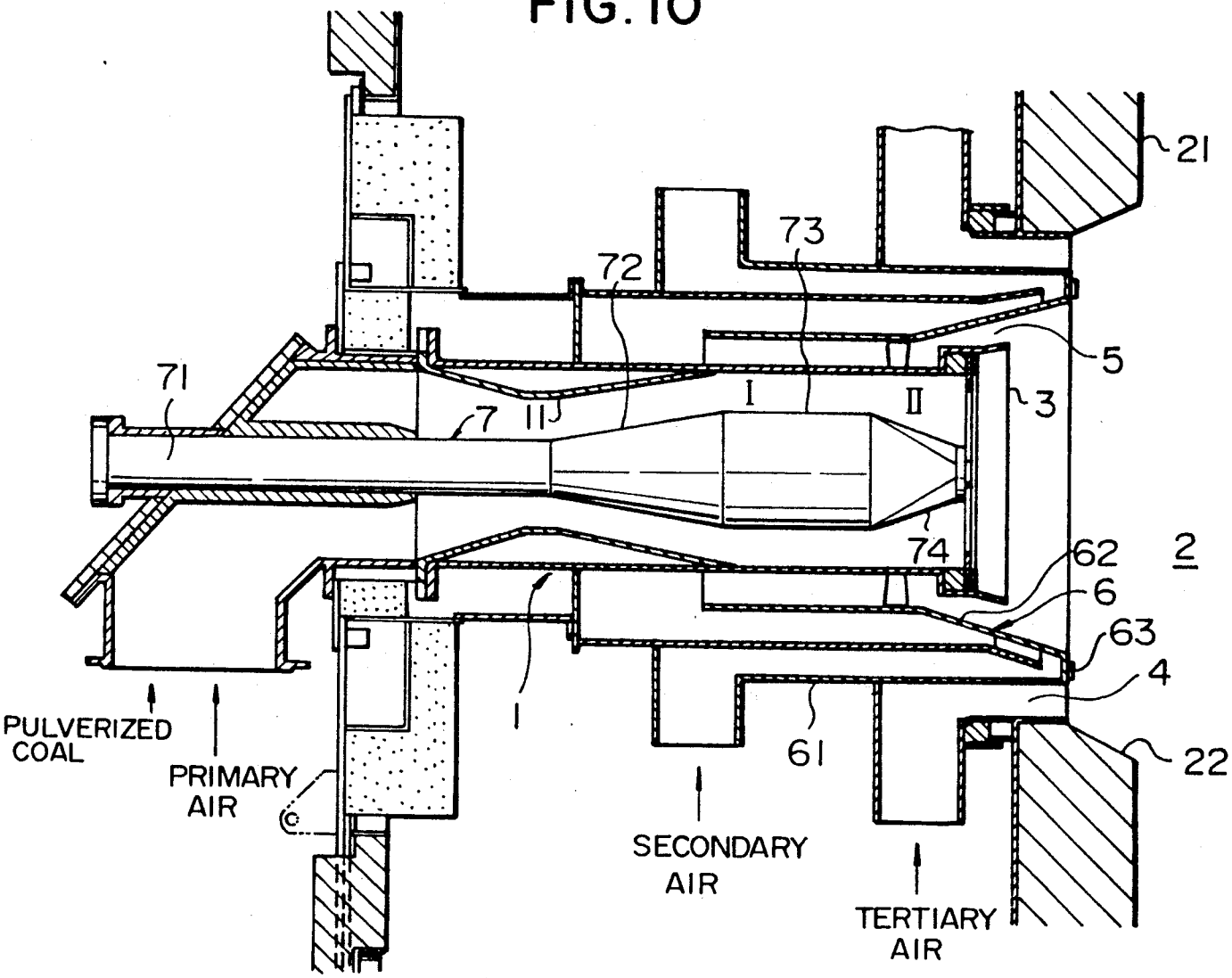
FIG. 10 is a sectional view of another embodiment of the combustion apparatus.
Figure 11:
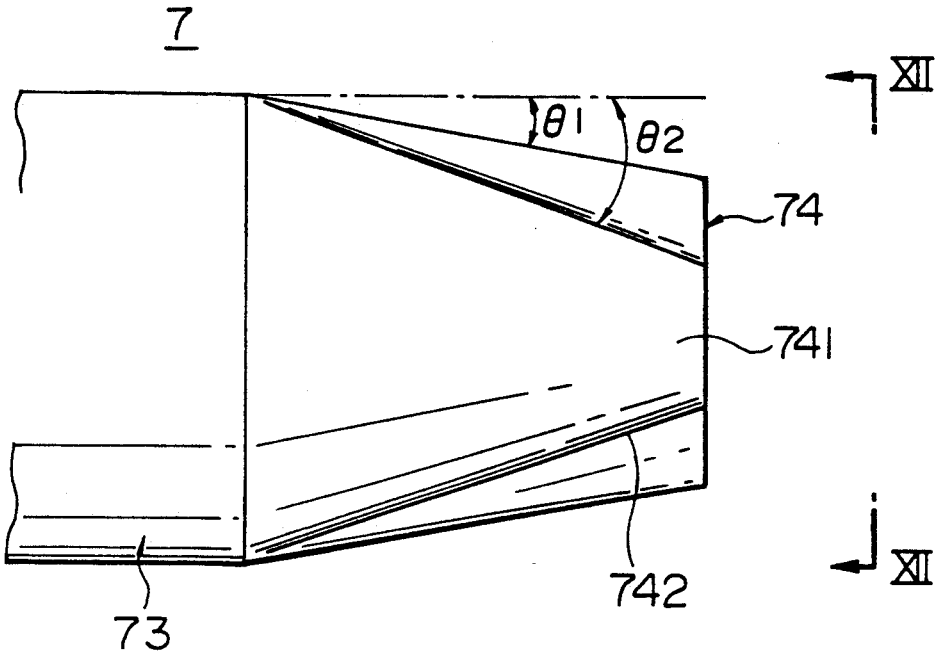
FIG. 11 is a side view illustrating a conical portion of a pulverized coal/air separating member shown in FIG. 10.

In another the embodiment of FIG. 10, in order to increase the concentration of the mixture around the mixture feeding pipe 1, a pulverized coal/air separating rod member 7 is disposed inside of the mixture feeding pipe 1 coaxially. The separating member 7 is attached to the mixture feeding pipe 1 at a stem portion 71 thereof. The separating member 7 includes a flared portion 72 defining a throat portion in cooperation with a projecting member 11 provided in the mixture feeding pipe 1. A speed of the mixture is reduced at the throat portion. Further, the separating member 7 comprises a right circular cylindrical portion 73 and a conical portion 74 which extends from the right circular cylindrical portion so as to be tapered toward the downstream side of the flow of the mixture. The right circular cylindrical portion 73 cooperates with the mixture feeding pipe 1 to define therebetween a mixture passage portion I having a constant sectional area t. The conical portion 74 cooperates with the mixture feeding pipe 1 to define therebetween a mixture passage portion II having a gradually increasing sectional area in a direction of the flow of the mixture.

The speed of the mixture is increased in the passage portion I and when the mixture flows through the passageway portion II, the pulverized coal is separated from the mixture due to its inertia and then flows in radially outward direction. As a result, the pulverized coal is concentrated in the vicinity of the flame maintaining ring 3. Therefore, even if the load of the combustion apparatus is reduced, to for example, about 30% of the load of the mill, it is possible to effect a highly efficient combustion a lower amount of NOx being produced. However, if the conical portion 74 is uniformly tapered, there is a possibility that the mixture may separate from the conical portion. Once the separation occurs, the pulverized coal 1 once concentrated in the vicinity of the flame maintaining ring, is radially inwardly displaced due to separated flow, resulting in the possibility that the concentration of pulverized coal in the vicinity of the flame maintaining ring 3 is reduced. Further, it is impossible to specify the location where such separation is caused. For this reason, according to this embodiment of the invention, the separation of the flow occurs exactly or forcibly at the predetermined portions on the conical portion. Additionally, the portions at which the separation occurs are circumferentially located. In other words, the portions where the separation is prevented from occurring are circumferentially equiangularly located as well. Consequently, the concentration of the pulverized coal in the vicinity of the flame maintaining ring becomes circumferentially uniform, and therefore, it is possible to effect a stabilized combustion.

Figure 12:
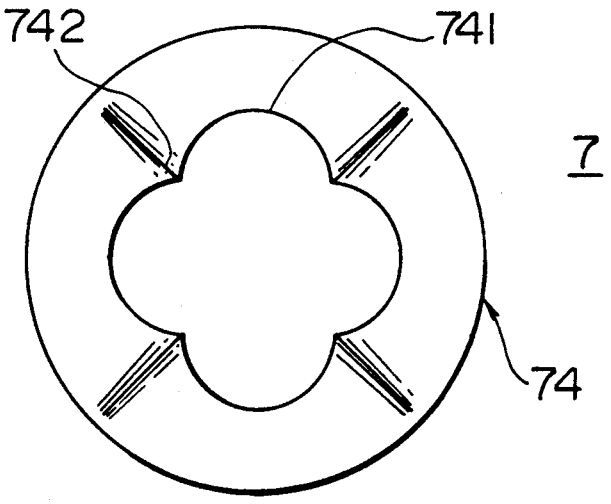
FIG. 12 is a front view taken along the lines XII—XII in FIG. 11.
Figure 13:
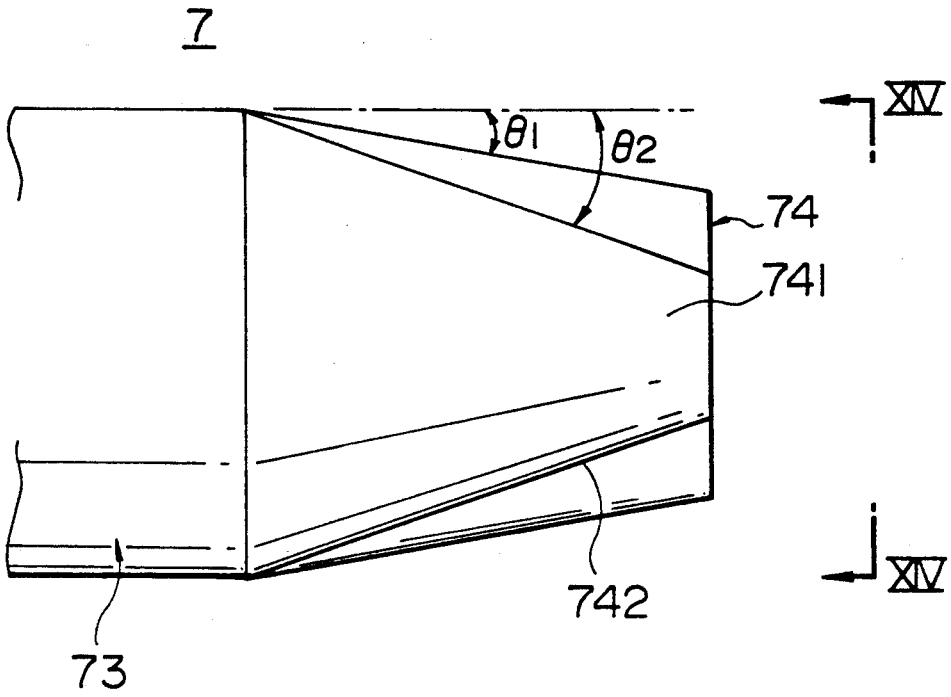
FIG. 13 is a side view illustrating the conical portion of another pulverized coal/air separating member.
Figure 14:
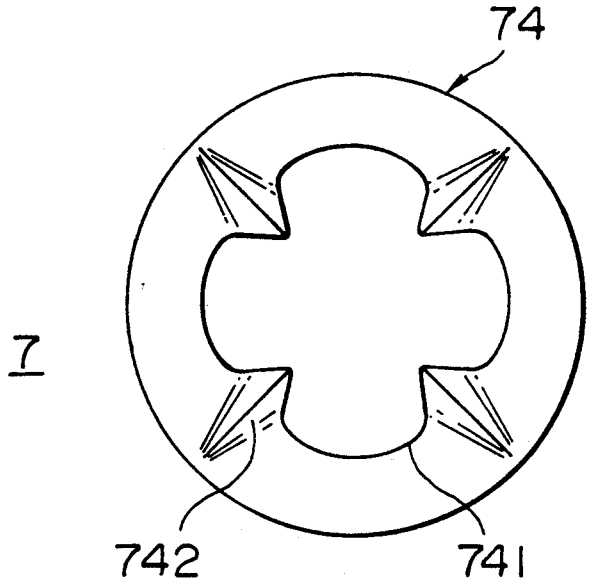
FIG. 14 is a front view taken along the lines XIV—XIV in FIG. 13.
Figure 15:
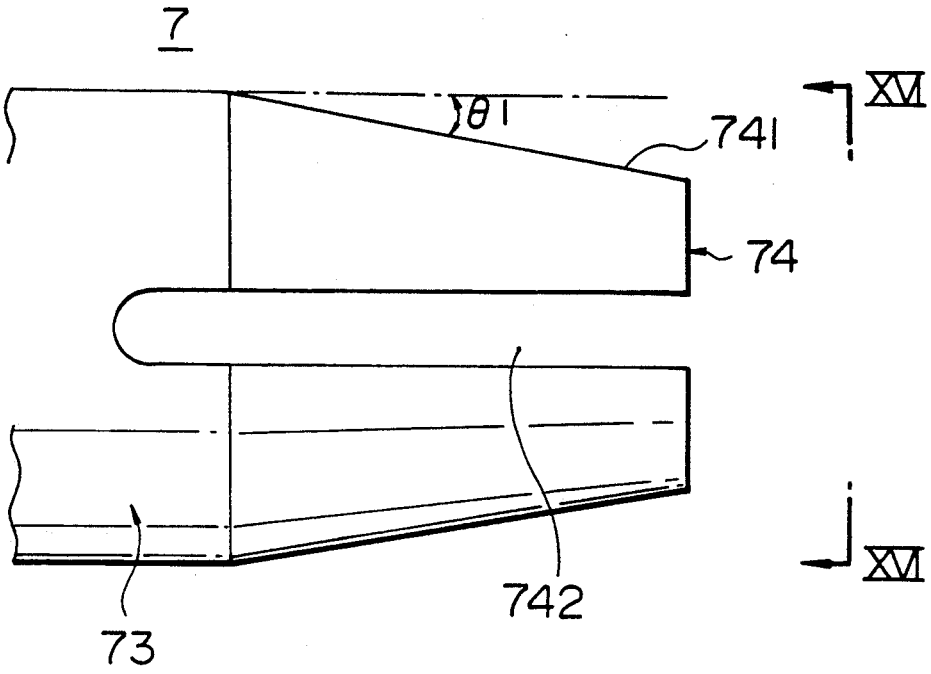
FIG. 15 is a side view illustrating the conical portion of still another pulverized coal/air separating member.
Figure 16:
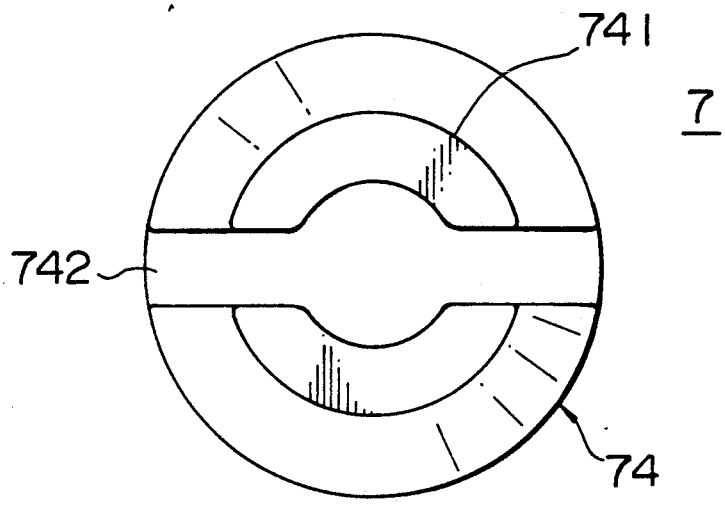
FIG. 16 is a front view taken along the lines XVI—XVI in FIG. 15.

To this end, in the present embodiment, the conical portion 74 includes portions 741 each subtending a tapering angle $\theta_1$ with respect to the axial direction and portions 742 each subtending a tapering angle $\theta_2$ ($>\theta_1$) with respect to the axial direction, which portions 741 alternate with the portions 742, as shown in FIGS. 11 to 14. The tapering angle $\theta_1$ is in the range of between 5° to 15°, and the tapering angle $\theta_2$ is in the range of 25° to 65°. The separation occurs in the portions 742 but is does not occur in the portions 741. Further, the area occupied by the portions 741 is larger than that occupied by the portions 742. Consequently, the effect of the separation can be minimized, thereby enhancing a stabilized combustion. The portions 741 and 742 may be connected smoothly, as shown in FIG. 12 or steeply, as shown in FIG. 14. The tapering angle $\theta_2$ of the portion where the separation occurs is not limited to $\theta_2$ the range of 25° to 65°. Even when the tapering angle $\theta_2$ is 90°, that is, even when the portion 742 is a slit as shown in FIGS. 15 and 16, the same effect can be obtained.

Figure 17:
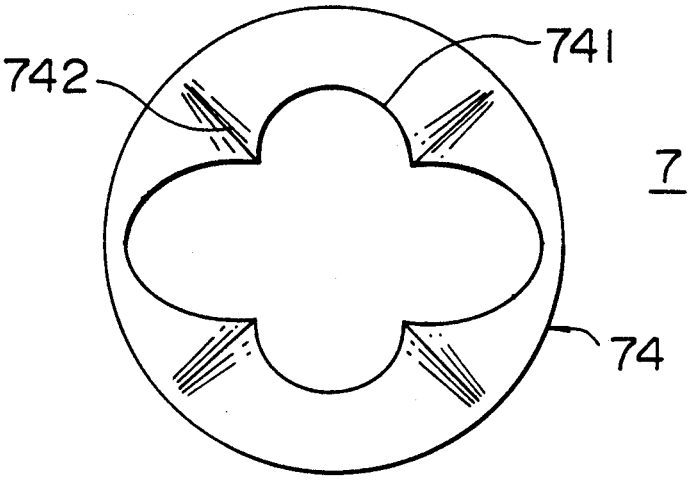
FIGS. 17 to 19 are sectional views illustrating other modifications of the conical portion of the pulverized coal/air separating member, respectively.
Figure 18:
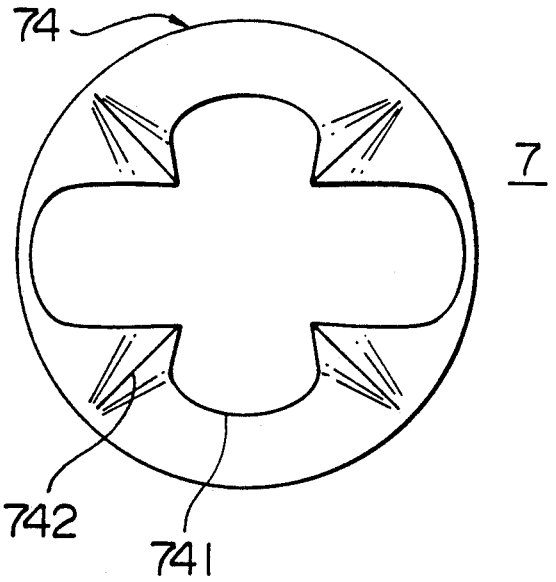
Figure 19:
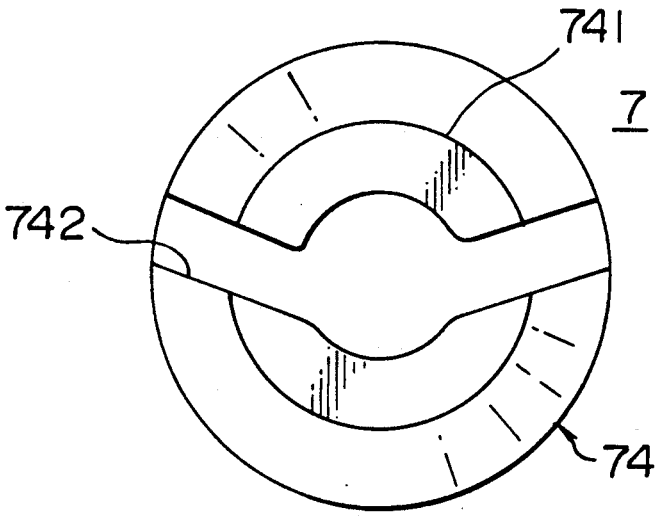

Furthermore, as shown in FIGS. 17 to 19, the portions 741 and 742 may be arranged asymmetrically.

Additionally, although the projection and the pulverized coal/air separating member are integral in this embodiment, the pulverized coal/air separating member and the projection can be individual elements.

Figure 20:
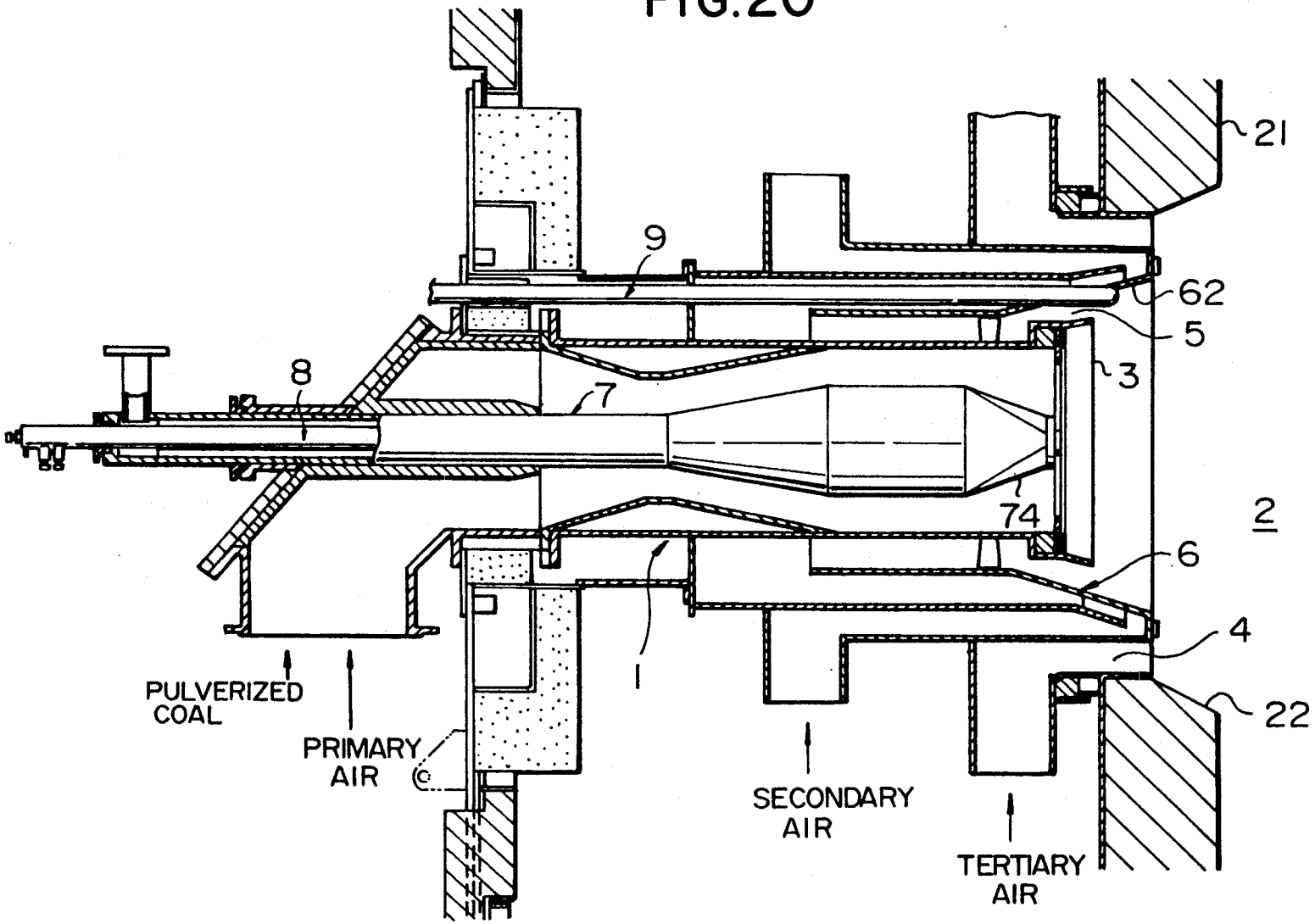
FIG. 20 is a sectional view of a different combustion apparatus.

Moreover, the present invention is also applicable to a pulverized coal combustion apparatus as shown in FIG. 20 which is equipped with a start-up oil burner 8 and an auxiliary gas burner 9. The oil burner 8 extends through the separating member 7 to the tip end of the conical portion 74. The gas burner 9 extends through the inner peripheral wall 62 into the furnace 2 to the extent that it can be prevented from being exposed to the radiation from the inside of the furnace 2.

What is claimed is:

1. A combustion apparatus comprising:

a mixture feeding pipe exposed in a furnace for feeding a mixture of powdery fuel and oxygen-containing gas into said furnace;

flame maintaining means provided at an exposed peripheral edge portion of said mixture feeding pipe;

a gas feeding passage disposed radially outwardly of said mixture feeding pipe for feeding oxygen-containing gas into said furnace;

projection means disposed between said gas feeding passage and said mixture feeding pipe with respect to the radial direction and extending into said furnace beyond said flame maintaining means so as to prevent said flame maintaining means from being exposed to radiation from inside of said furnace;

means for forming an oxidizing atmosphere around a surface of said projection which is exposed in said furnace; and a powdery fuel/oxygen-containing gas separating member disposed inside of said mixture feeding pipe coaxially with said mixture feeding pipe, and wherein said separating member includes a right circular cylindrical portion cooperable with said mixture feeding pipe to define therebetween a mixture feeding passage portion a sectional area of which is substantially constant, and a conical portion extending from said right circular cylindrical portion and being tapered toward a downstream side of the flow of the mixture so as to cooperate with said mixture feeding pipe to define therebetween another mixture feeding passage portion having a sectional area which is gradually increased in a direction of the flow of the mixture, said conical portion having a portion where separation of the flow occurs and another portion where separation of the flow does not occur which passage portions alternate circumferentially.

2. A combustion apparatus comprising:

a mixture feeding pipe exposed in a furnace for feeding a mixture of powdery fuel and oxygen-containing gas into said furnace;

flame maintaining means provided at an exposed peripheral edge portion of said mixture feeding pipe;

a gas feeding passage disposed radially outwardly of said mixture feeding pipe for feeding oxygen-containing gas into said furnace; and a powdery fuel/oxygen-containing gas separating member coaxially disposed inside of said mixture feeding pipe, said separating member including a right circular cylindrical portion cooperable with said mixture feeding pipe to define therebetween a mixture feeding pasage portion having a constant cross sectional area, and a conical portion extending from said right circular cylindrical portion and being tapered toward a downstream side of the flow of the mixture, said conical portion being cooperable with said mixture feeding pipe to define therebetween another mixture feeding passage portion having a sectional area gradually increasing in a direction of the flow of the mixture, said conical portion having a portion where separation of the flow occurs and another portion where separation of the flow does not occur, which passage portions alternate circumferentially.

3. A combustion apparatus according to claim 2, wherein a circumferential dimension of said portion where the separation of the flow occurs is less than that of said another portion where separation of the flow does not occur.

4. A combustion apparatus according to claim 2, wherein a peripheral surface of said conical portion of said powdery fuel/oxygen-containing gas separating member is provided with portions having differing tapering angles with respect to the axis of said conical portion.

* * * * *